US006676533B1

(12) United States Patent
Hsien

(10) Patent No.: US 6,676,533 B1
(45) Date of Patent: Jan. 13, 2004

(54) ANGLE ADJUSTABLE GOLF CLUB

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 0 days.

(21) Appl. No.: 10/289,275

(22) Filed: Nov. 7, 2002

(51) Int. Cl.[7] ..... A63B 69/36; A63B 53/06
(52) U.S. Cl. ..... 473/247
(58) Field of Search ..... 473/244, 245, 473/246, 247

(56) References Cited

U.S. PATENT DOCUMENTS

| | | | | | |
|---|---|---|---|---|---|
| 670,522 | A | * | 3/1901 | Thompson | 473/247 |
| 2,217,338 | A | * | 10/1940 | Fuller | 473/247 |
| 2,329,313 | A | * | 9/1943 | Winter | 473/247 |
| 2,520,701 | A | * | 8/1950 | Verderber | 473/247 |
| 3,214,169 | A | * | 10/1965 | Rupnow | 473/246 |
| 3,791,647 | A | * | 2/1974 | Verderber | 473/247 |
| 3,840,231 | A | * | 10/1974 | Moore | 473/245 |
| 4,883,274 | A | * | 11/1989 | Hsien | 473/335 |
| 5,393,056 | A | * | 2/1995 | Richardson | 473/247 |

FOREIGN PATENT DOCUMENTS

| | | | | |
|---|---|---|---|---|
| GB | 8864 | * | of 1892 | 273/79 |
| GB | 15713 | * | of 1909 | 273/79 |
| GB | 124361 | * | 3/1919 | 273/79 |

* cited by examiner

*Primary Examiner*—Sebastiano Passaniti
(74) *Attorney, Agent, or Firm*—Rosenberg, Klein & Lee

(57) ABSTRACT

A golf club includes a shaft and a neck is connected to an end of the shaft. A connection rod extends from the neck. A club head has a connection member at an end thereof and the connection rod is rotatably inserted in the connection member. A positioning assembly extends in the connection member from a side of the connection member and contacts the connection rod which is fixed at a pre-selected angle relative to a vertical plane by the positioning assembly.

4 Claims, 6 Drawing Sheets

ANGLE ADJUSTABLE GOLF CLUB

FIELD OF THE INVENTION

The present invention relates to a golf club which has a golf club head rotatably connected to the shaft and can be fixed at a pre-desired angle.

BACKGROUND OF THE INVENTION

A conventional golf club generally includes a shaft and a club head which is connected to an end of the shaft. The golf club has an impact face which is located at a plane at an angle relative to the plane where the shaft is located. By the angled impact face, the golf ball is expected to be sent to a desired height and distance. There are several golf clubs for a whole club set, from number 1 to number 7, putter, and wedges. Each of the clubs has a specific angled impact face and the golfer has to choose a correct number of golf club to play a golf game. Nevertheless, the beginner of golf sport uses only few of the club set and he or she has to buy a whole set of golf club. This is inconvenient for the beginners and most of the clubs are not used or seldom used.

The present invention intends to provide an angle adjustable golf club that has a club head which is rotated about a connection rod on the neck of the shaft so that the user may buy one golf club to play different functions.

SUMMARY OF THE INVENTION

In accordance with one aspect of the present invention, there is provided a golf club which comprises a shaft and a neck connected to an end of the shaft. A connection rod extends from the neck. A club head has a connection member located at an end thereof and the connection rod is rotatably inserted in the connection member. A positioning assembly extends in the connection member from a side of the connection member and contacts the connection rod.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is an exploded view to show the angle adjustable club head of the present invention;

DETAILED DESCRIPTION OF THE PREFERRED EMBODIMENT

Figure 1:
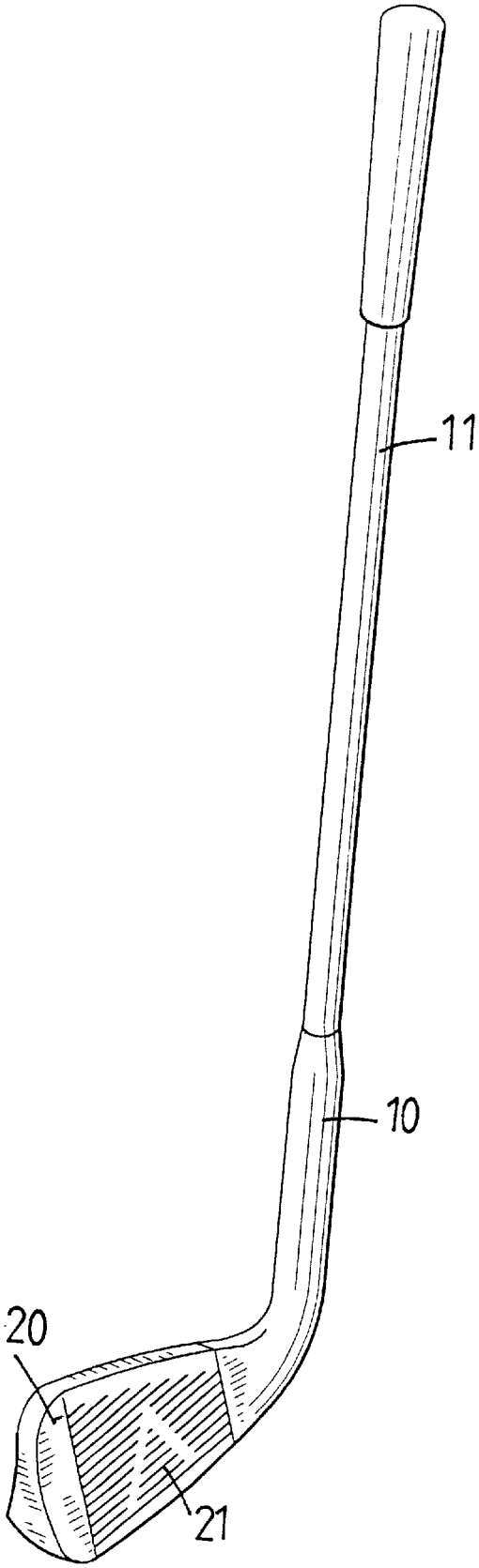
FIG. 1 is a perspective view to show the golf club of the present invention.
Figure 2:
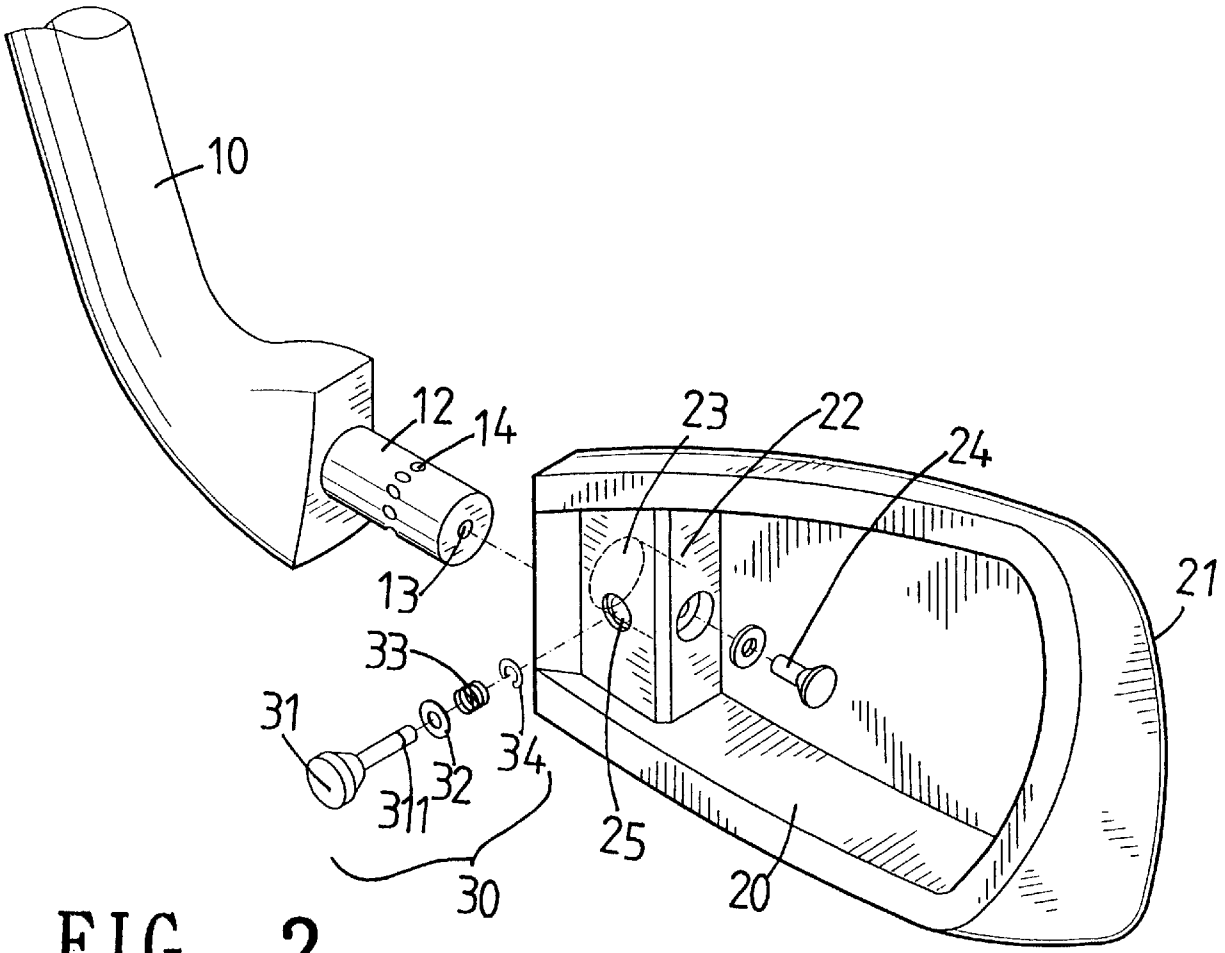
Figure 3:
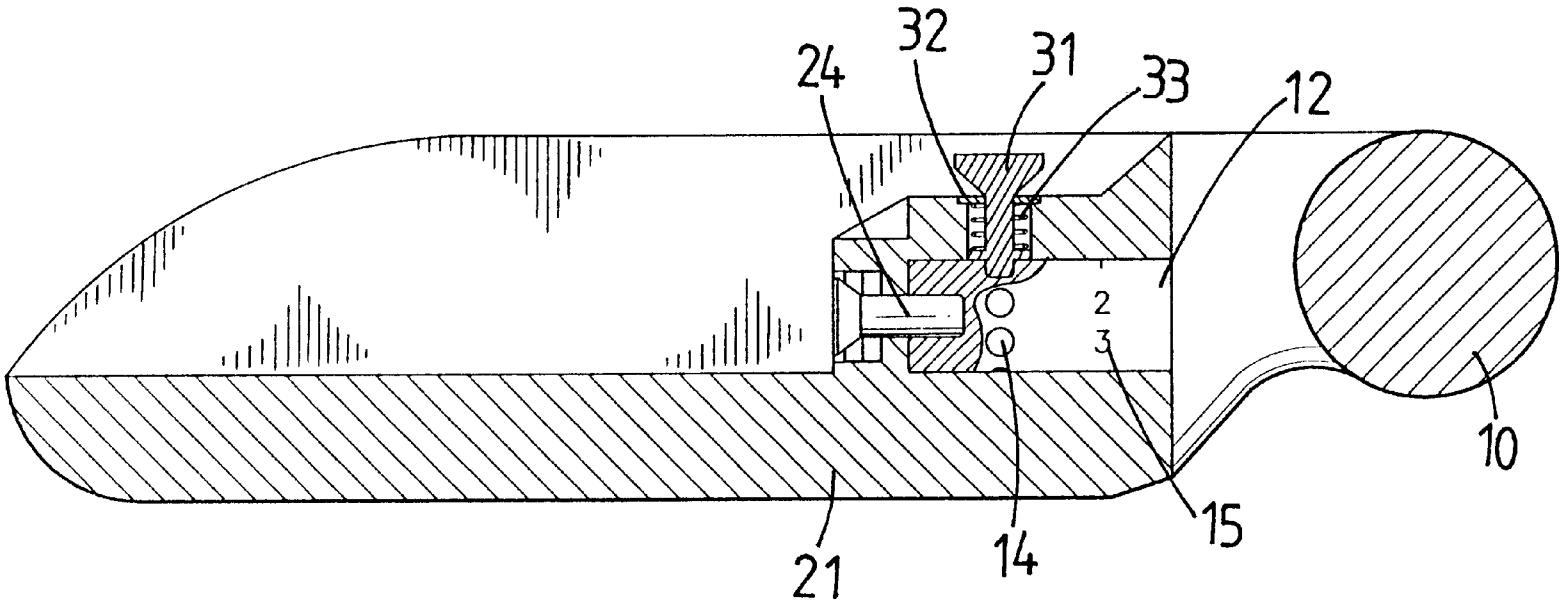
FIG. 3 is a cross sectional view to show the angle adjustable club head of the present invention.

Referring to FIGS. 1 to 4, the golf club of the present invention comprises a shaft 11 and a neck 10 is connected to a first end of the shaft 11 and a handle is connected to a second end of the shaft 11. A connection rod 12 extends from the neck 10 and includes a plurality of recesses 14 defined in an outer periphery thereof. A positioning hole 13 is defined in a distal end of the connection rod 12.

A club head 21 has a connection member 22 located at an end thereof and a insert hole 23 is defined through the wall of the club head 21 so that the connection rod 12 is rotatably inserted in the connection member 22. A positioning pin 24 extends through the connection member 22 and is engaged with the positioning hole 13 of the connection rod 12 so that the connection rod 12 can be rotatably positioned relative to the connection member 22.

A positioning assembly 30 includes a pin 31 biased by a spring 33, a washer 32 and a C-shaped clamp 34, the pin 31 is inserted through a side hole 25 in a wall of the connection member 22 and engaged with one of the recesses 14. The pin 31 has a groove 311 so that the C-shaped clamp 34 is engaged with the groove 311 so that the spring 33 is biased between the C-shaped clamp 34 and the washer 32.

Figure 6:
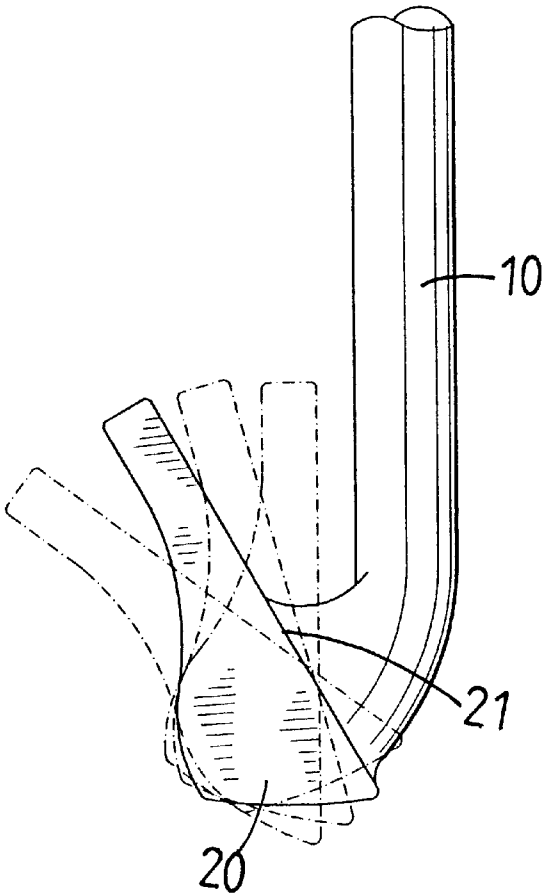
FIG. 6 shows the club head is adjusted at different angles.
Figure 4:
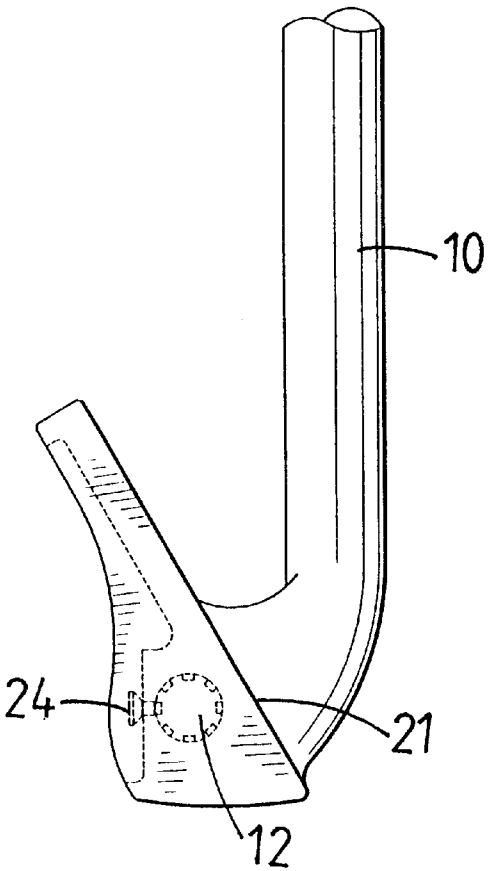
FIG. 4 is an end view to show the angle adjustable club head of the present invention.
Figure 5:
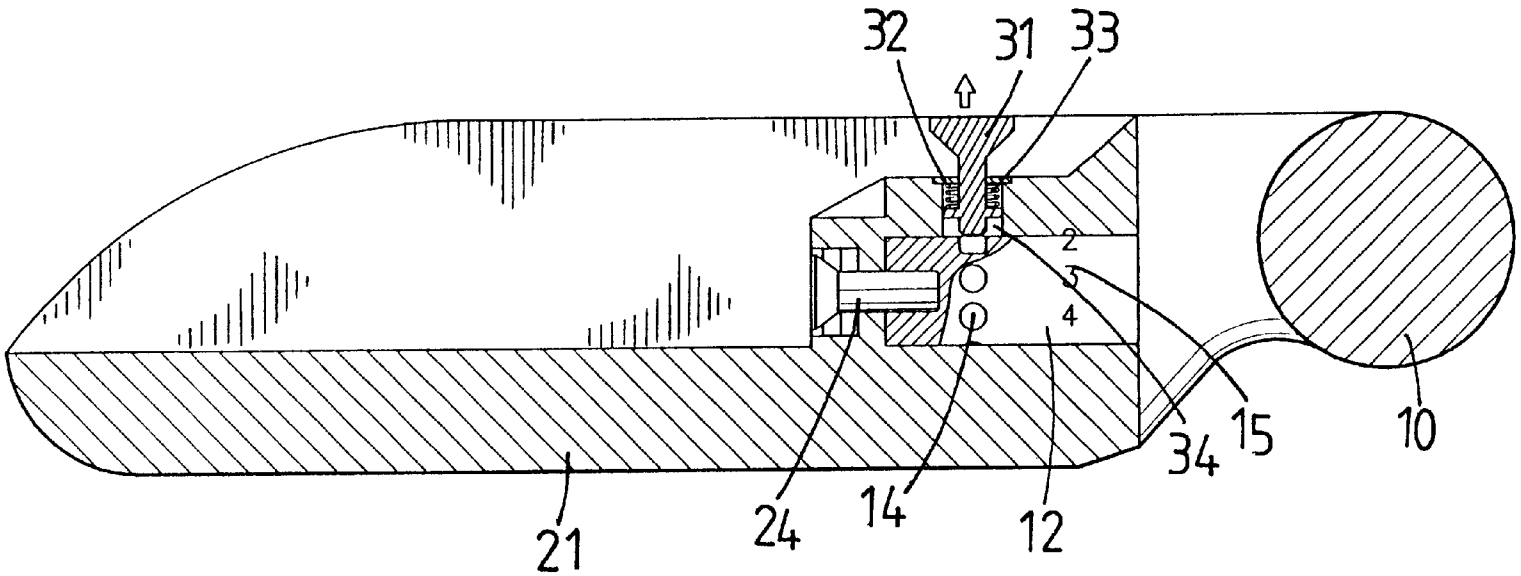
FIG. 5 is a cross sectional view to show how to adjust the club head.
Figure 7:
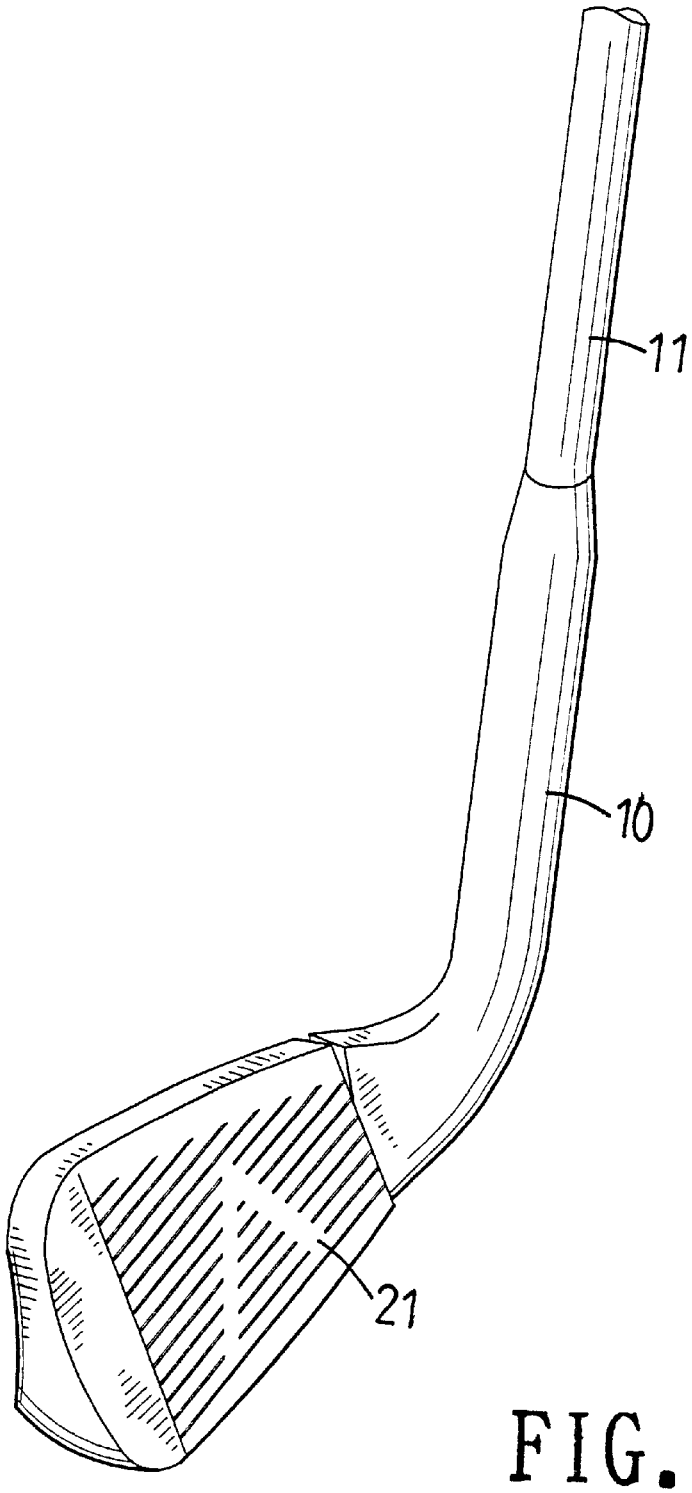
FIG. 7 shows the club head is rotated at an angle.

Referring to FIGS. 5 to 7, when pulling the pin 31 outward to disengage the distal end of the pin 31 from the recess 14 by compressing the spring 33, the club head 21 can be rotated relative to the connection rod 12 and the pin 31 is released to be inserted in the other recess 14 so that the club head 21 is positioned at another angle position. By the present invention, the club head 21 can be adjusted to different angle positions and proceeds different functions.

While we have shown and described the embodiment in accordance with the present invention, it should be clear to those skilled in the art that further embodiments may be made without departing from the scope of the present invention.

What is claimed is:

1. A golf club comprising:

a shaft and a neck connected to an end of the shaft, a connection rod extending from the neck, the connection rod includes a plurality of recesses defined in an outer periphery thereof, and a club head having a connection member located at an end thereof and the connection rod rotatably inserted in the connection member, a positioning assembly extending in the connection member from a side of the connection member and including a pin biased by a spring, the pin inserted in one of the recesses.

2. The golf club as claimed in claim 1 further comprising a positioning pin extending through the connection member and engaged with a positioning hole defined in a distal end of the connection rod.

3. A golf club comprising:

a shaft and a neck connected to an end of the shaft, a connection rod extending from the neck;

a club head having a connection member located at an end thereof and the connection rod rotatably inserted in the connection member, a positioning assembly extending in the connection member from a side of the connection member and contacting the connection rod, and a positioning pin extending through the connection member and engaged with a positioning hole defined in a distal end of the connection rod.

4. The golf club as claimed in claim 3, wherein the connection rod includes a plurality of recesses defined in an outer periphery thereof and the positioning assembly includes a pin biased by a spring, the pin inserted in one of the recesses.

* * * * *